United States Patent [19]

Schlobohm

[11] Patent Number: 4,562,837

[45] Date of Patent: Jan. 7, 1986

[54] AIR ESCAPE FILTER APPARATUS

[75] Inventor: Joachim Schlobohm, Bad Oldesloe, Fed. Rep. of Germany

[73] Assignee: Drägerwerk Aktiengesellschaft, Fed. Rep. of Germany

[21] Appl. No.: 536,516

[22] Filed: Sep. 28, 1983

[30] Foreign Application Priority Data

Sep. 29, 1982 [DE] Fed. Rep. of Germany ..... 3236028

[51] Int. Cl.[4] ..... A62B 7/00

[52] U.S. Cl. ..... 128/206.17

[58] Field of Search ..... 128/206.12, 206.17, 128/201.25

[56] References Cited

U.S. PATENT DOCUMENTS

| | | | |
|---|---|---|---|
| 4,154,235 | 5/1979 | Warncke | 128/201.25 |
| 4,467,795 | 8/1984 | Eckstein | 128/206.17 |
| 4,473,072 | 9/1984 | Walther | 128/206.12 |

FOREIGN PATENT DOCUMENTS

| | | | |
|---|---|---|---|
| 530285 | 12/1940 | United Kingdom | 128/206.17 |

*Primary Examiner*—Henry J. Recla

*Attorney, Agent, or Firm*—McGlew and Tuttle

[57] ABSTRACT

An air escape filter apparatus for emergency use by a person comprises a filter which is contained within a filter housing which is accommodated within a half mask portion of a breathing mask which is adapted to be engaged over the nose and mouth of a person. The half mask portion includes a sleeve portion having a guide ring which engages over the filter housing and is shiftable along the filter housing while remaining in holding engagement therewith. The filter housing is of a size so that it is retainable within the half mask portion in a standby condition at which time it is substantially coextensive in length with the half mask portion so that the two elements are accommodated within a very small space. The filter is extensible at the end of the sleeve portion to free the interior of the half mask for engagement over the wearer's face in a ready condition.

6 Claims, 2 Drawing Figures

AIR ESCAPE FILTER APPARATUS

FIELD AND BACKGROUND OF THE INVENTION

This invention relates in general to breathing apparatus and in particular to a new and useful escape breathing apparatus having a filter.

One learns again and again that people are hurt in fires, in hotels for example. Simple escape filters ready to be seized would facilitate their rescue. Such escape equipment is carried on the person and therefore is always at hand only if they are easy to accommodate in the luggage. They must therefore occupy a minimum of space.

Known is an escape filter apparatus with protective hood, accommodated in a receptacle. Into a protective hood the breathing connection of a half mask is tightly fitted. The half mask receives a breath filter. In the ready position the escape filter apparatus is accommodated in a standby receptacle. A low overall height is obtained by appropriate folding of the protective hood and cuffing of the face edge over the breath filter. (DE-GM No. 82 04 996.3). The cuffing of the face edge of the half mask over the breath filter, as a prerequisite for the low height, constitutes a critical factor and requires, especially because the standby time may be long, a selected mask material.

Another escape filter apparatus with a half mask and a breath filter has become known, with which the problem of the low overall height is to be solved by a special configuration of the half mask. Here the breath filter is connected to a foldable half mask. To this end the half mask consists of a face frame and a tubular foldable connection piece to the breath filter. In the low receptacle the connection piece is folded up, so that either the face frame rests directly on the breath filter, or the face frame is designed so that it can be slipped over the breath filter (DE-GM No. 82 24 371.9).

SUMMARY OF THE INVENTION

The invention provides an escape filter apparatus with a breath filter in a half mask, which both require the smallest possible receptacle with lowest mounting height for accommodation.

According to the invention the face portion fitting over the breath filter is prolonged in a guide portion and contains at its inside end a guide ring which slides on the breath filter, and terminates in a stop which spans the filter entrance.

A particular advantage achieved with the invention is that it is a very simple new design of a half mask having advantages over the known mouthpieces with the necessary nose clamp, so that an extremely low mounting height results. The latter is determined only by the breath filter height. The guide ring for the breath filter in the guide portion of the half mask assures, together with a stop portion, a stable hold thereof. For the wearer of the escape filter apparatus a convenient, comfortable mode of wearing is thereby assured in an otherwise critical situation. With the filter pushed through, the stop acts as a further seal.

The additional equipment with a protective hood makes use possible also under especially critical conditions.

Accordingly it is an object of the invention to provide a breathing device which comprises a filter for filtering out undesirable breathing constituents from the surrounding air and which is accommodated within a sleeve portion of a half mask in a standby position and which may be extended out through the sleeve portion to free the interior of the half mask for engagement over the wearer's face in an emergency.

A further object of the invention is to provide an air escape filter apparatus which is simple in design, rugged in construction and economical to manufacture.

The various features of novelty which characterize the invention are pointed out with particularity in the claims annexed to and forming a part of this disclosure. For a better understanding of its operating advantages and specific objects attained by it uses, reference is made to the accompanying drawings and descriptive matter in which a preferred embodiment of the invention is illustrated.

DESCRIPTION OF THE PREFERRED EMBODIMENT

Figure 1:
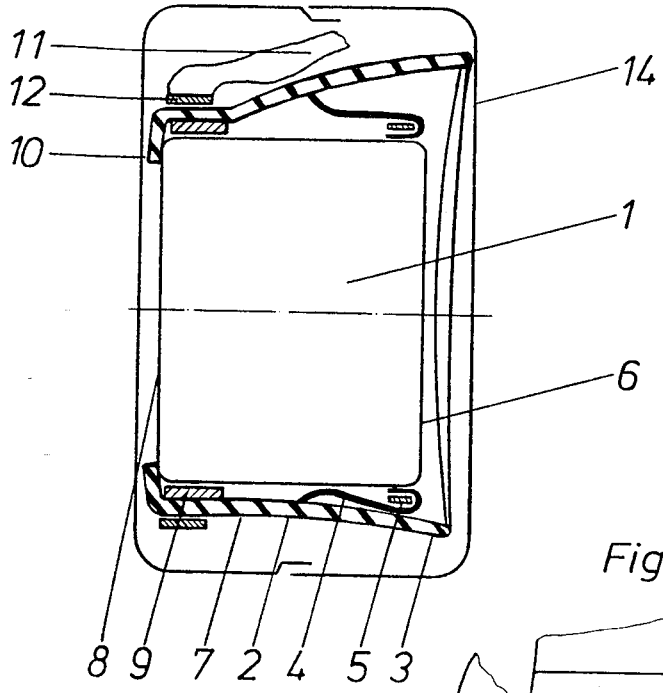
FIG. 1 is a sectional view of an escape filter apparatus shown in a standby or mounted state and constructed in accordance with the invention.

Referring to the drawings in particular the invention embodied therein comprises an air escape filter apparatus for emergency use by a person and which comprises a filter contained within a housing 1 and shown in FIG. 1 in a standby position contained within a half mask portion 2 which is adapted to engage around the nose and mouth of a person. The half mask portion includes a sleeve 7 with a guide ring 9 and the guide ring engages over the filter housing 1 and is shiftable along the filter housing in holding engagement therewith.

The filter housing 1 is retainable in the standby position within the half mask portion and it is substantially coextensive in length or depth with the half mask portion as shown in FIG. 1.

Figure 2:
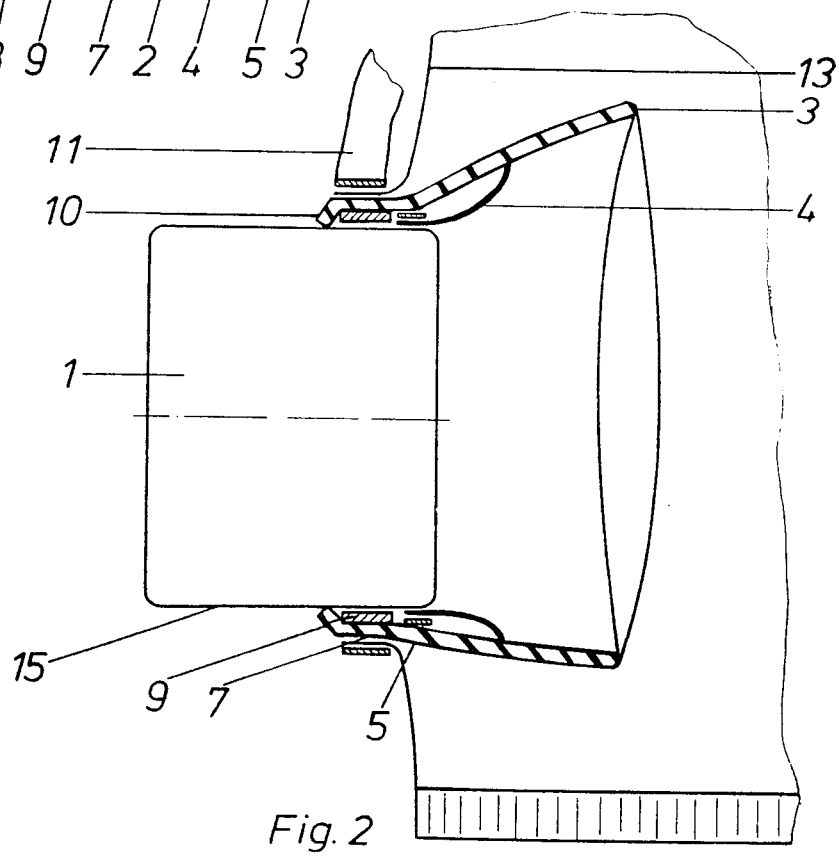
FIG. 2 is a view similar to FIG. 1 showing the escape filter apparatus in a ready condition for use by a wearer.

In accordance with the invention, when it is desirable to extend the filter housing with the filter 1 out of the end of the sleeve portion 7 to free the interior of the half mask, the filter housing 1 is merely pushed through the opened end of the sleeve portion so as to deflect the stop part 10 and to free the interior of the half mask for use by the wearer as shown in FIG. 2.

The escape filter apparatus comprises a breath filter 1, which is tightly connected to a cylindrical half mask 2. The half mask 2 is composed of a face portion 3, which can be slipped over the breath filter 1 and of a flexible connecting piece or bellows 4. Over the soft bellows 4 the half mask 2 is fastened by means of a shackle 5 located adjacent an exit 6 of the filter 1.

The face portion 3 is continued in a guide sleeve 7, by which the breath filter is spanned up to the filter entrance 8. The guide sleeve 7 carries a guide ring 9 around the filter 1 and the sleeve terminates in a stop 10. Stop 10 limits the path of movement and determines the position of the breath filter 1.

The guide ring 9 has a diameter which makes it easy to push the filter 1 through the ring up to the stop 10. A head band 11 is held by means of a shackle 12 above the guide sleeve 7 and the guide ring 9. Thus, in a special design of the escape filter apparatus, a protective hood 13 can be held by the band 11 over the wearer's head.

FIG. 1 shows the escape filter apparatus in the mounted state within a receptacle 14 and illustrates the low mounting height.

In the state of use according to FIG. 2, here with the protective hood 13, the breath filter 1 is pushed past the stop 10 through the guide sleeve 7 and the guide ring 9 from the inside. The sleeve 7 with the guide ring 9 are moved along the filter 1 until the ring abuts against the shackle 5. The stop 10, made of the known elastic material of respirators, places itself around a housing or jacket 15 of the filter 1 and thus together with the guide ring 9 gives the breath filter 1 the necessary hold while the escape filter apparatus is being worn.

While a specific embodiment of the invention has been shown and described in detail to illustrate the application of the principles of the invention, it will be understood that the invention may be embodied otherwise without departing from such principles.

What is claimed is:

1. An air escape filter apparatus for emergency use by a person comprising a filter having an exterior filter housing, a half mask defining a space and adapted to engage around the nose and mouth of a person, said half mask having an opening and a sleeve portion defined around said opening, a guide ring carried by said sleeve portion and engaged around said filter housing, said filter housing being slidable on said guide ring from a retracted standby position in and substantially filling said half mask space to an extended use position extending at least partly out of said half mask space in said half mask opening, said filter housing having a length substantially co-extensive to a length of said half mask space, and a bellows connected between filter housing and said half mask for permitting movement of said filter housing between its retracted standby position and its extended use position whereby, with said filter housing in its extended use position, at least some of said half mask space is available for the nose and mouth of a person.

2. An air escape filter apparatus according to claim 1, wherein said sleeve portion includes an end which is bent inwardly toward said filter housing and defines a stop against which said filter housing may be pressed during a standby position, said bent end being elastic and deflectable to permit said filter housing to be forced through the sleeve past the bent end.

3. An air escape filter apparatus according to claim 1, including a protective hood engaged around said half mask.

4. An air escape filter apparatus according to claim 3, including a container defining a container space, said half mask with said filter housing in its retracted standby position disposed in said container space, said container having a cover portion which is removable to open said container space for releasing said half mask and filter housing, said container having a depth substantially equal to said co-extensive length of said filter and said half mask space.

5. An air escape filter apparatus according to claim 1, including a shackle engaged around said filter housing at one thereof, said filter having an opposite end which faces the opening of said half mask sleeve portion, said guide ring of said sleeve portion being engaged with said shackle when said filter housing is in its extended use position for the limiting said extended use position and preventing said filter housing from moving entirely through said half mask opening.

6. An air escape filter apparatus according to claim 5, wherein said filter shackle is engaged around one end of said bellows to hold said bellows against said filter housing.

* * * * *